US009207562B2

(12) United States Patent
Hiramatsu et al.

(10) Patent No.: US 9,207,562 B2
(45) Date of Patent: Dec. 8, 2015

(54) IMAGE FORMING APPARATUS

(71) Applicant: CANON KABUSHIKI KAISHA, Tokyo (JP)

(72) Inventors: Takashi Hiramatsu, Tokyo (JP); Yasunari Watanabe, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/283,070

(22) Filed: May 20, 2014

(65) Prior Publication Data

US 2014/0348523 A1 Nov. 27, 2014

(30) Foreign Application Priority Data

May 22, 2013 (JP) ..... 2013-107964
Apr. 9, 2014 (JP) ..... 2014-080316

(51) Int. Cl.

| | |
|---|---|
| ***G03G 15/00*** | (2006.01) |
| ***G03G 15/02*** | (2006.01) |
| ***G03G 15/043*** | (2006.01) |
| ***G03G 15/047*** | (2006.01) |

(52) U.S. Cl.
CPC ..... *G03G 15/047* (2013.01)

(58) Field of Classification Search
CPC ..... G03G 15/043
USPC ..... 399/44; 347/135
See application file for complete search history.

(56) References Cited

U.S. PATENT DOCUMENTS

2012/0147119 A1* 6/2012 Toyoizumi et al. ..... 347/224

FOREIGN PATENT DOCUMENTS

| | | |
|---|---|---|
| JP | 1-50089 A | 4/1984 |
| JP | 59-133573 A | 7/1984 |

* cited by examiner

*Primary Examiner* — David Gray
*Assistant Examiner* — Michael Harrison
(74) *Attorney, Agent, or Firm* — Canon U.S.A., Inc. IP Division

(57) ABSTRACT

An image forming apparatus includes an image bearing member that bears a developer image, a transfer apparatus that transfers the developer image, a charge apparatus, an exposure apparatus that exposes the surface of the image bearing member with light to form a latent image, and a developing apparatus that collects and supplies the developer to the latent image to form the developer image, in which an image formation area is divided into an image part and a non-image part where the developer image is not formed, the exposure apparatus exposes the non-image part with light at an exposure amount lower than an exposure amount with respect to the image part, and the charging apparatus charges the image bearing member and the exposure apparatus exposes the image part and the non-image part with light in a state in which the developer remains on the image bearing member.

8 Claims, 4 Drawing Sheets

IMAGE FORMING APPARATUS

BACKGROUND OF THE INVENTION

1. Field of the Invention

The present invention relates to an image forming apparatus such as, for example, a copier or a printer that is provided with a function of forming an image on a recording medium such as a sheet.

2. Description of the Related Art

Up to now, an image forming apparatus using an electrophotographic system is constituted by a photosensitive member serving as an image bearing member, a charge apparatus, an exposure apparatus, a developing apparatus, a transfer apparatus, a cleaning apparatus, a fixing apparatus, and the like. An image is formed on a recording medium by performing the following procedures (electrophotographic process).

First, the photosensitive member is uniformly charged (charging procedure), a latent image is formed on the photosensitive member that has been subjected to the charging processing (exposure procedure). Then, the latent image formed on the photosensitive member is developed by toner serving as a developer (developing procedure), and this toner image is transferred from the photosensitive member to the recording medium (transfer material) (transfer procedure), so that the toner transferred to the recording medium is fixed on the recording medium (fixing procedure). The residual toner after the transfer is removed and cleaned from the photosensitive member (cleaning procedure).

The residual toner on the photosensitive member after the transfer procedure is removed from a photosensitive member surface by the cleaning apparatus and remains in the cleaning apparatus to become waste toner. However, from the viewpoints of environmental protection, effective utilization of resources, miniaturization of the apparatus, and the like, no waste toner is preferably produced. In view of the above, Japanese Patent Laid-Open No. 59-133573 or the like discloses a cleaner-less system image forming apparatus in which the residual transfer toner is collected in the developing apparatus (so-called "cleaning simultaneous with developing"), and the residual transfer toner is removed from the photosensitive member to be collected and reused.

However, in the image forming apparatus adopting the cleaner-less system, the charging processing is performed by the charge apparatus in a state in which the residual toner after the transfer is adhered onto the photosensitive member. When the photosensitive member is charged by the charge apparatus in a state in which this residual toner is present, the charging is conducted on both the residual toner and the photosensitive member. In the above-described charging on the photosensitive member from above the toner, in a part where the residual toner is present, a charging potential on the photosensitive member is disturbed by the toner as compared with a charging potential (Vd) at the photosensitive member in a normal case where the toner is absent. Thus, the potential on the photosensitive member is decreased as compared with the charging potential (Vd) in a part where the residual toner is absent. Since the charging on the photosensitive member is disturbed in proportion to the amount of the residual toner, when the amount of the residual toner is high, the decrease amount of the photosensitive member charging potential is increased. Therefore, when the cleaning simultaneous with developing is performed in a state in which when the amount of the residual toner is high to some degree, the residual toner itself is collected by the developing apparatus, but the charging potential on the photosensitive member in the relevant part is low. If a latent image is formed by exposure in a state in which the charging potential on the photosensitive member in the part where the residual toner exists as described above is low, a latent image potential is decreased (an absolute value of the potential is decreased) in the relevant part. Thus, a density in a half-tone image in particular is thickened, and a so-called positive ghost may be generated.

As measures for this problem, Japanese Patent Laid-Open No. 1-50089, for example, discloses an image forming apparatus in which a member for uniformly dispersing the residual toner is provided on an upstream side of the charging member. In this apparatus, the residual toner is sucked and removed from the photosensitive member by a memory removal member before the charging procedure after the transfer procedure. In this manner, since the residual toner is collected and removed from the photosensitive member, it is possible to suppress the decrease in the charging potential caused by the toner, and the generation of the positive ghost caused by the residual transfer toner is suppressed.

However, a problem occurs that the above-described memory removal member is disadvantage in the cleaner-less system when a space and a cost are taken into account.

This is because, although the miniaturization of the apparatus is to be advanced from the viewpoint of the space, if the miniaturization is advanced, the photosensitive member, the charge apparatus, the exposure apparatus, the developing apparatus, and the transfer apparatus are close to each other, and it is difficult to secure the space for the memory removal member to be arranged between the transfer apparatus and the charge apparatus. In addition to this, since the memory removal member is provided, the cost for the member is generated.

SUMMARY OF THE INVENTION

The present invention has been made in view of the above-described circumstances and provides an image forming apparatus adopting a system of cleaning simultaneous with developing in which a miniaturization and a cost reduction of an apparatus are realized while a generation of a defective image caused by a decrease in a charging potential in a part of an image bearing member where a residual developer exists is suppressed.

To achieve the above-described aim, a representative configuration of the present invention relates to an image forming apparatus that forms an image on a recording medium, the image forming apparatus including: an image bearing member that bears a developer image; a transfer apparatus configured to transfer the developer image borne on the image bearing member; a charge apparatus configured to charge a surface of the image bearing member; an exposure apparatus configured to expose the surface of the image bearing member with light to form a latent image on the surface of the image bearing member; and a developing apparatus configured to collect a developer that is not transferred by the transfer apparatus and remains on the image bearing member and also supplies the developer to the latent image formed on the surface of the image bearing member to form the developer image on the surface of the image bearing member, in which an image formation area where the latent image on the surface of the image bearing member can be formed is divided into an image part where the developer image is formed and a non-image part where the developer image is not formed, the exposure apparatus exposes the non-image part with light at an exposure amount lower than an exposure amount with respect to the image part, and the charging apparatus charges the image bearing member and the exposure apparatus exposes the image part and the non-image part with light in a state in which the developer remains on the image bearing member.

Further features of the present invention will become apparent from the following description of exemplary embodiments with reference to the attached drawings.

DESCRIPTION OF THE EMBODIMENTS

Hereinafter, exemplary embodiments for carrying out this invention will be described in detail with reference to the drawings. It is however noted that dimensions, materials, and shapes of constituting components described according to the exemplary embodiments, relative arrangements of those constituting components, and the like are to be appropriately changed depending on a configuration of an apparatus to which the present invention is applied and various conditions, and the scope of this invention is not intended to be limited to the following exemplary embodiments. The present invention relates to a cleaner-less image forming apparatus. More specifically, the invention relates to an image forming apparatus of a cleaner-less system in which a cleaning apparatus is abolished while toner serving as a developer remains on an image bearing member after a transfer procedure is removed and collected by a developing apparatus through cleaning simultaneous with developing from the image bearing member to be reused.

Exemplary Embodiments

Hereinafter, exemplary embodiments will be described.

Overall Configuration of Image Forming Apparatus

Figure 2:
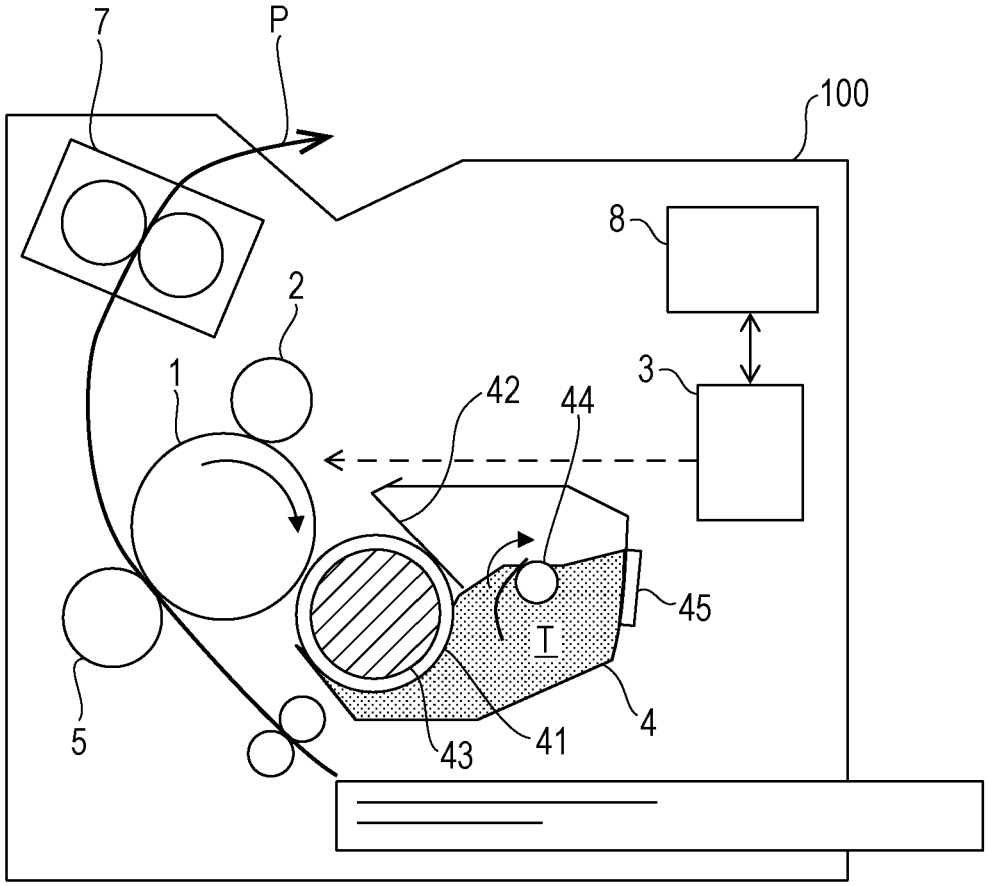
FIG. 2 is a cross sectional view of a schematic configuration of an image forming apparatus according to the exemplary embodiment.

FIG. 2 is a cross sectional view of a schematic configuration of a printer 100 serving as the image forming apparatus according to the present exemplary embodiment. Hereinafter, an image forming operation will be described.

When the image forming operation is started, a photosensitive member (photosensitive drum) 1 serving as an image bearing member is rotated and driven in an arrow direction of FIG. 2 by a photosensitive member drive motor.

A negative voltage is applied to a charging roller 2 serving as a charging unit (charge apparatus) configured to charge a surface of the photosensitive member 1 from a power supply for charging at a predetermined time, and as a result, the photosensitive member 1 is uniformly negatively charged. A laser exposure unit 3 serving as an exposure unit (exposure apparatus) configured to expose the photosensitive member 1 with light repeats exposure in a main scanning direction (rotating shaft direction of the photosensitive member 1) by using laser beam in accordance with image data and also performs exposure in a sub scanning direction (surface movement direction of the photosensitive member 1). According to this, an electrostatic latent image (latent image) is formed on the surface of the photosensitive member 1. The formation of the electrostatic latent image in the exposure procedure according to the present exemplary embodiment will be described below.

A developing device 4 serving as a developing unit (developing apparatus) includes a developing sleeve 41. A developing bias Vdc is applied on the developing sleeve 41 from a developing bias power supply, and the developer is supplied to the electrostatic latent image formed on the photosensitive member 1, so that the electrostatic latent image is visualized (developed) into the developer image. Here, the developing device 4 will be described.

The developing sleeve 41 is rotatably supported to the developing device 4. The developing sleeve 41 is prepared by arranging a conductive elastic rubber layer having a predetermined volume resistivity around a hollow open pipe made of a non-magnetic metal (such as aluminum). A magnet roller 43 is fixed and arranged in an inner circumference of the developing sleeve 41. Magnetic single-component toner (negative charge characteristic) T serving as the developer in the developing device 4 is agitated by an agitation member 44 in a developing container, and the toner T is supplied to a surface of the developing sleeve 41 by magnetic force of the magnet roller 43 in the developing device 4 through this agitation. The toner T supplied to the surface of the developing sleeve 41 is uniformly formed into a thin layer while passing through a developing blade 42 and is also subjected to a frictional electrification to be charged to have a negative polarity. After that, the toner T on the developing sleeve 41 is conveyed to a developing position in contact with the photosensitive member 1, so that the electrostatic latent image formed on the photosensitive member 1 is developed to form a toner image on the photosensitive member 1. According to this, the photosensitive member 1 bears the toner image (developer image).

The toner image visualized on the photosensitive member 1 is further conveyed to a transfer nip part (contact part) between the photosensitive member 1 and a transfer roller 5 and transferred onto a recording medium P conveyed at a matching timing at this transfer nip part. A transfer bias is applied between the transfer roller 5 and the photosensitive member 1 by the power supply.

The recording medium P onto which the toner image is transferred is conveyed to a fixing apparatus 7. In the fixing apparatus 7, the transferred toner image is fixed on the recording medium P while heat and pressure are applied to the recording medium P.

On the other hand, the residual transfer toner remaining on the photosensitive member 1 without being transferred is conveyed to a charging position between the charging roller 2 and the photosensitive member 1. At this time, a voltage for charging the photosensitive member 1 is applied to the charging roller 2, and the residual transfer toner is negatively charged together with the photosensitive member 1 by the discharge. Since the residual transfer toner is forcedly negatively charged, the residual transfer toner passes through the charging roller 2 without being adhered to the charging roller 2 by an electric field between the charging roller 2 and the negatively charged photosensitive member 1.

After that, when the residual transfer toner is conveyed to the developing position along with the rotation of the photosensitive member 1, the residual transfer toner is moved towards a side of the developing sleeve 41 by a potential difference between the dark area potential Vd at the surface of the photosensitive member 1 and the developing bias Vdc in a non-image part and adhered to the developing sleeve 41 to be collected into the developing device 4. In this manner, the so-called cleaning simultaneous with developing is performed at the developing position. Herein, the non-image part is a part of the surface of the photosensitive member 1 where the toner image is not formed (non-image area).

In an image part, the residual transfer toner is not moved towards the side of the developing sleeve 41 by an electric field between a light area potential V1 at the surface of the photosensitive member 1 and the developing bias Vdc and remains on the surface of the photosensitive member 1 as it is (the image part is originally a part where the image formation is performed), and after that, the residual transfer toner is transferred to the recording medium P. Herein, the image part is a part of the surface of the photosensitive member 1 where the toner image is formed (image area).

The image forming operation is executed while the above-described procedures are repeatedly performed.

The developing device 4 is provided with a memory 45 as a storage unit (storage apparatus). The memory 45 according to the present exemplary embodiment is a non-volatile memory and is configured so that write and read can be performed as appropriate. The memory 45 can store held data even when a printer main body power supply is turned OFF. The memory 45 previously stores various information at the time of manufacturing.

A control unit 8 is a unit (apparatus) configured to control an operation of the printer 100. The control unit 8 supplies and receives various electric information signals and governs a predetermined sequence control of the image formation (image creation), write and read of the memory 45, and the like.

Latent Image Setting and Laser Exposure Unit

Figure 3A:
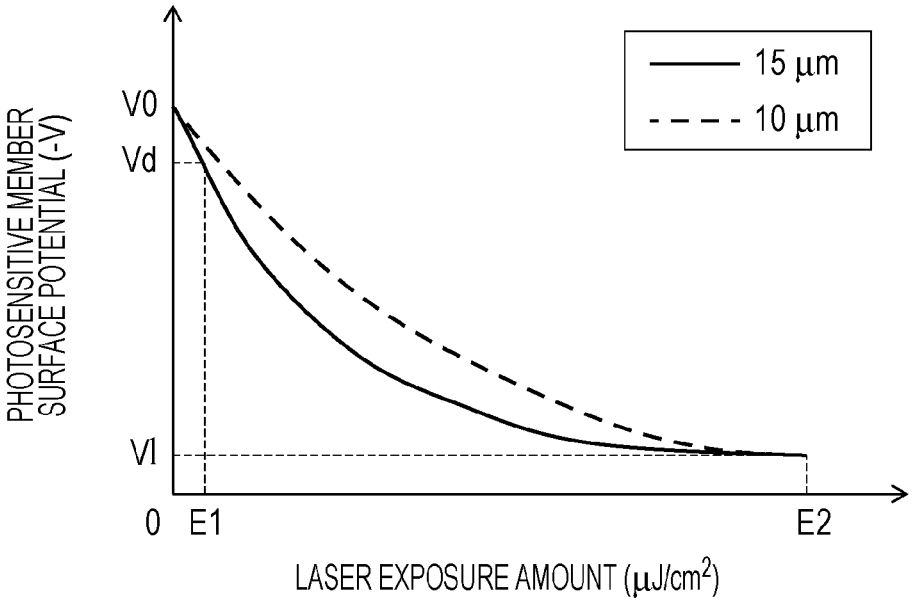
FIGS. 3A and 3B are explanatory diagrams for describing a latent image setting according to the exemplary embodiment.
Figure 3B:
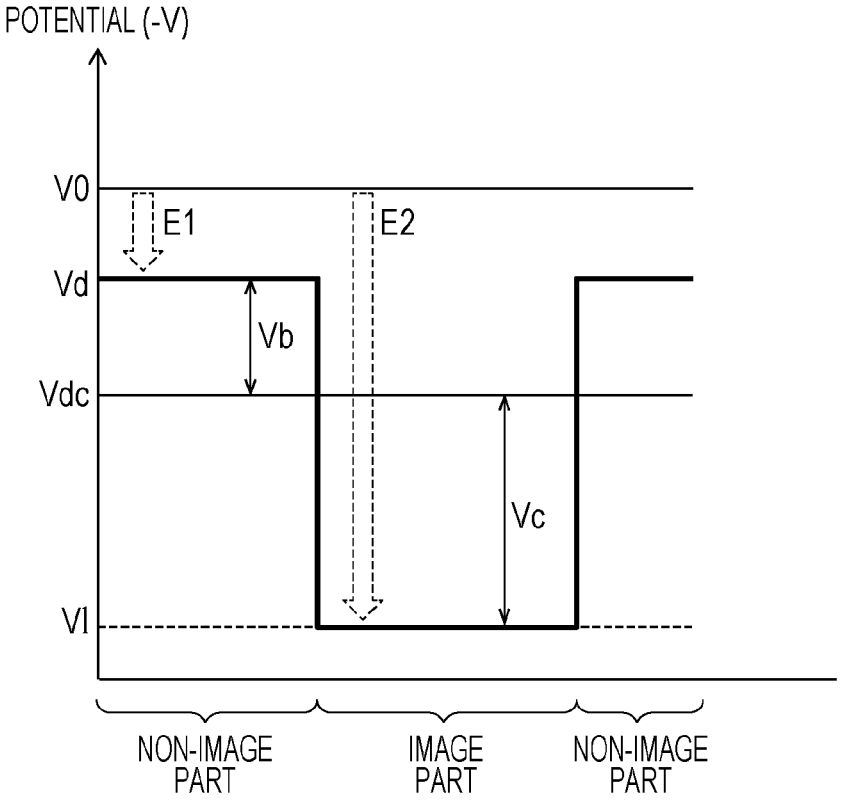

FIGS. 3A and 3B are explanatory diagrams for describing a latent image setting according to the present exemplary embodiment. Hereinafter, the latent image setting according to the present exemplary embodiment will be described.

The photosensitive member 1 according to the present exemplary embodiment is a so-called organic photosensitive member in which a charge generating layer is formed on an aluminum cylinder-like substrate, and a charge transport layer is formed on an upper layer thereof. An external diameter of the photosensitive member 1 according to the present exemplary embodiment is 24 (mm).

When the image forming procedure (image forming operation) is started, a DC voltage (Vpri) that is higher than or equal to a discharge starting voltage is applied to the charging roller 2 having an external diameter at 8 (mm), and a primary charging potential (V0) is formed on the surface of the photosensitive member 1. In DC charging, when the voltage that is higher than or equal to the discharge starting voltage is applied to the charging roller 2, a charging potential is linearly formed with respect to the applied voltage.

Herein, the laser exposure unit 3 according to the present exemplary embodiment is configured in a manner that output values can be switched and output between two levels of a first laser power E1 and a second laser power E2 as a laser output (exposure amount) when the surface of the photosensitive member 1 is exposed with light. That is, a laser power control unit configured to control laser power exposed from the laser exposure unit 3 in accordance with the image part and the non-image part is provided.

The laser power control unit according to the present exemplary embodiment individually selects the first laser power E1 as laser power for the dark area potential Vd with respect to the non-image part and the second laser power E2 as laser power for the light area potential V1 with respect to the image part. According to the present exemplary embodiment, the following configuration is adopted. That is, the laser is caused to weakly emit laser while a predetermined current flows through a laser diode in the image forming procedure, and this is set as the first laser power E1 with respect to the non-image part. The second laser power E2 is set while a wanted current in addition to the above-described predetermined current flows through the laser diode with respect to the image part. The laser power control unit controls the first and second laser powers E1 and E2 by variably controlling the amount of the current flowing through the laser diode.

FIG. 3A illustrates relationships between the surface potential on the photosensitive member 1 according to the present exemplary embodiment and the laser power (hereinafter, which will be referred to as E-V curved lines) when film thicknesses of the photosensitive layer are respectively 15 (μm) and 10 (μm). In FIG. 3A, the horizontal axis represents laser power E ($\mu J/cm^2$) received by the surface of the photosensitive member 1, and the vertical axis represents a surface potential V (−V) at the photosensitive member 1 when the relevant laser power is received. A surface speed of the photosensitive member 1 is 150 (mm/sec). As may be understood from FIG. 3A, the E-V curved line varies depending on the film thickness, and when the film thickness is decreased, an inclination of the E-V curved line is decreased (the absolute value is decreased).

The laser exposure unit 3 performs the exposure at the second laser power E2 ($\mu J/cm^2$) with respect to the image part of the photosensitive member 1 to form the light area potential V1. At the same time, the laser exposure unit 3 also performs the exposure at the first laser power E1 ($\mu J/cm^2$) that is lower than the second laser power E2 with respect to the non-image part (background) to form the dark area potential Vd. Since the predetermined DC voltage is applied to the developing sleeve 41, with regard to the negatively charged toner conveyed to the developing position, the electrostatic latent image is reversely developed as the toner image by a potential difference between the light area potential V1 on the photosensitive member 1 and the developing bias Vdc.

The printer 100 according to the present exemplary embodiment uses a reversal development system in which the charging by the charging roller 2 on the photosensitive member 1 is performed on the basis of minus charging, and the development is performed by minus charge toner. Therefore, an area exposed at the second laser power E2 ($\mu J/cm^2$) corresponds to the image part, and an area exposed at the first laser power E1 ($\mu J/cm^2$) corresponds to a non-image part (background part).

An image formation area where the latent image can be formed by the exposure unit is set on the surface of the photosensitive member 1. The image formation area is set in accordance with a size of the recording media P and is divided into the image part and the non-image part. The image part corresponds to a part where the laser exposure unit 3 actually forms the latent image (part exposed with light at the second laser power E2 by the laser exposure unit 3), and the toner image is formed by the developing unit (developing device 4). On the other hand, the non-image part corresponds to a part where the latent image is not formed by the laser exposure unit 3 (part exposed with light at the first laser power E1 by the laser exposure unit 3). The non-image part is a background of the image part and is a part (background part) where the toner image is not part.

FIG. 3B is an explanatory diagram for describing a potential setting according to the present exemplary embodiment. A development contrast potential Vc corresponding to a difference between the light area potential V1 and the developing bias Vdc becomes a factor for setting an image density in the image part. That is, when the development contrast potential Vc is decreased, a sufficient image density is not obtained. For that reason, the development contrast potential Vc that is higher than or equal to a predetermined value is to be secured.

A background part contrast potential Vb corresponding to a difference between the developing bias Vdc and the dark area potential Vd becomes a factor for determining a so-called "fog" (texture soiling) amount or the like in the background part. That is, when the background part contrast potential Vb is increased beyond a predetermined value, reversely charged toner (that is, plus charge toner) is adhered to the background part to generate the fog, which becomes a cause of an image soiling, a soiling inside the apparatus, and the like. On the other hand, when the background part contrast potential Vb is decreased beyond a predetermined value, the normally charged toner (that is, minus charge toner) is developed in the background part and similarly generates the fog. For that reason, the background part contrast potential Vb is to be set within a predetermined range so that the fog is not generated.

Formation of Electrostatic Latent Image by Laser Exposure from Above Toner

In the image formation based on the cleaner-less system, the residual transfer toner that remains on the photosensitive member without being transferred from the photosensitive member to the recording medium is conveyed as it is to an abutting part between the charging roller and the photosensitive member. At this time, the photosensitive member is charged to the primary charging potential (V0) by the discharge from the charging roller in an area where the residual transfer toner is not generated. On the other hand, in an area where the residual transfer toner is generated, the photosensitive member is charged in a state in which the residual transfer toner is also included. To elaborate, in the charging based on the cleaner-less system, charging is performed while the photosensitive member also includes the toner. In the above-described charging while the residual transfer toner is included, with regard to the charging potential on the photosensitive member, the absolute value of the potential on the photosensitive member is decreased (the absolute value is decreased) by the amount corresponding to the presence of the toner (ΔV0 (−V)). In other words, the absolute value of the potential is difficult to be increased by the charging in the part where the toner exists (the increase amount is decreased).

In the cleaner-less system, since the potential in the area on the photosensitive member where this toner is removed is decreased, the background part contrast (Vb) is lower than the predetermined value, and the positive ghost may be generated.

In view of the above, according to the present exemplary embodiment, the dark area potential is formed by exposing the surface of the photosensitive member 1 with light at the first laser power E1, the decrease in the dark area potential in the part where the residual transfer toner is generated is suppressed.

Herein, the formation of the dark area potential at the first laser power E1 is as described above, but in a case where the residual transfer toner exists in the area to be exposed with light, the exposed light is shielded by the toner in the part.

That is, the laser is emitted from the laser exposure unit 3 at the first laser power E1 for the formation of the dark area potential, but in a case where the toner is present on the photosensitive member 1, the laser power is shielded by the toner. Herein, a laser power light shielding amount at which the laser power is shielded by the toner is set as Eη.

For this reason, the first laser power E1' actually received by the photosensitive member 1 at this time is calculated by E1'=E1−Eη.

Figure 4:
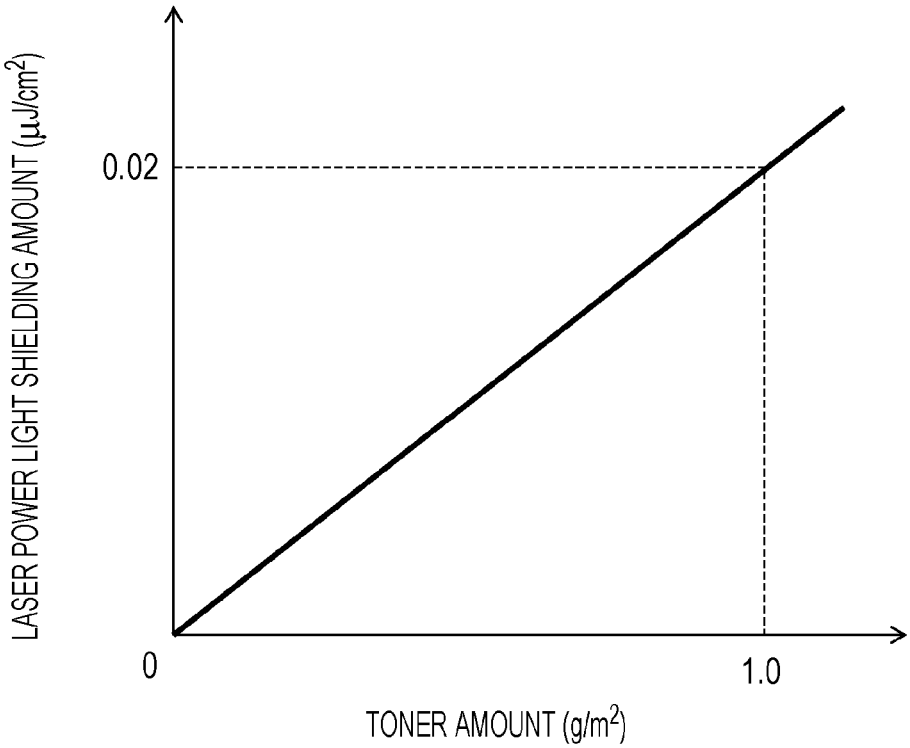
FIG. 4 illustrates a relationship between a toner amount on a photosensitive member and a light shield amount according to the exemplary embodiment.

FIG. 4 illustrates a relationship between a toner amount a ($g/m^2$) on the photosensitive member 1 and the laser power light shielding amount Eη by the toner. A laser wavelength of the laser exposure unit 3 is 780 (nm).

When the toner amount on the photosensitive member 1 is increased, the shield amount by the toner is also increased. Therefore, when the amount of toner on the photosensitive member 1 is high, the laser power actually received by the photosensitive member 1 is decreased. For that reason, a difference ΔVd (−V) between the dark area potential (Vd) in the residual transfer toner absent part and a dark area potential (Vd') in the residual transfer toner present part is smaller than the decrease amount ΔV0 of the charging potential on the photosensitive member 1. Herein, in the following explanation, the dark area potential is set as Vd in the residual transfer toner absent part of the surface of the photosensitive member 1, and the dark area potential in the residual transfer toner present part is set as Vd'.

Figure 1:
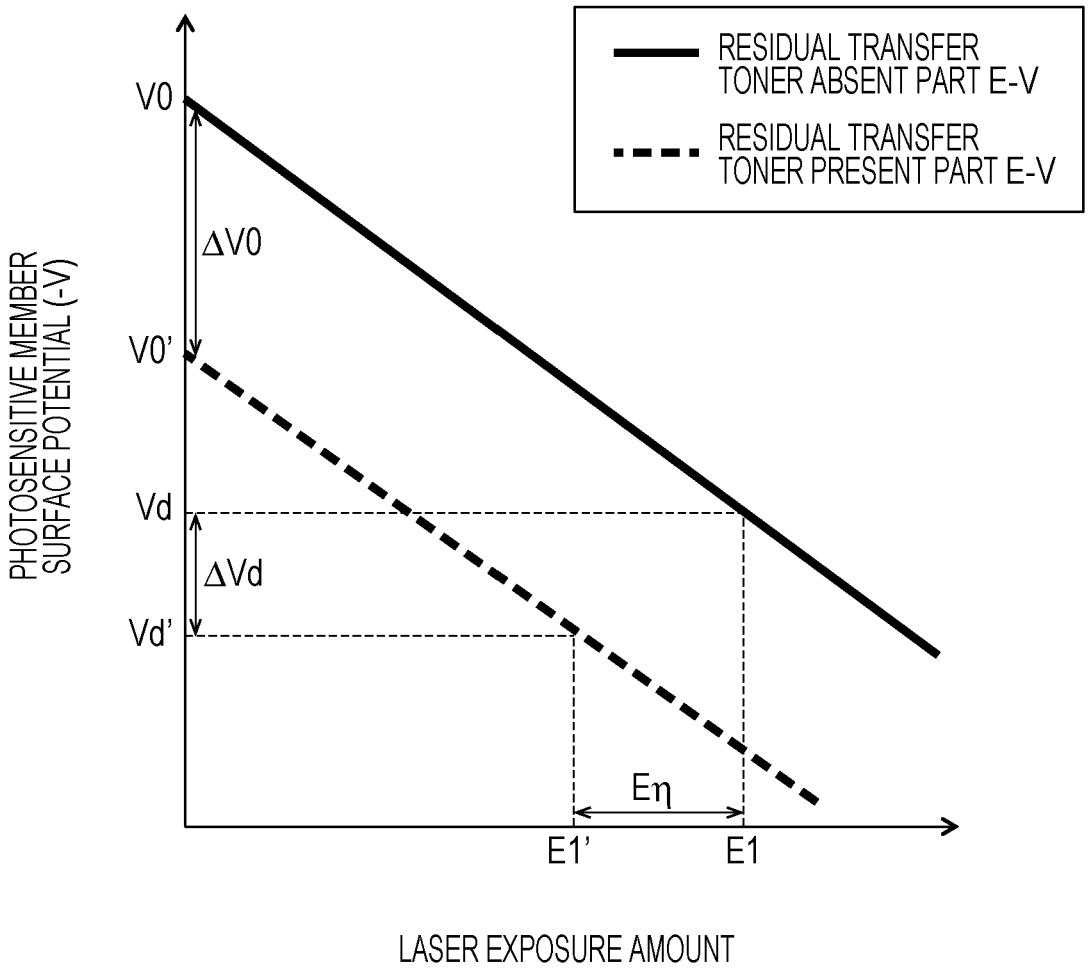
FIG. 1 illustrates E-V curved lines in a part where residual transfer toner is absent and a part where the residual transfer toner is present according to an exemplary embodiment.

FIG. 1 illustrates the E-V curved lines used when the dark area potential is formed in the part where the residual transfer toner is absent and the part where the residual transfer toner is present according to the present exemplary embodiment.

Although a detail will be described, as illustrated in FIG. 1, when the dark area potential is formed by the exposure from above the residual transfer toner, it is possible to suppress the decrease amount (potential difference of the primary charging potential) ΔV0 of the charging potential on the photosensitive member 1.

Photosensitive Member Dark Part Surface Potential Control

In the E-V curved line of the photosensitive member 1 in a case where the residual transfer toner is absent as illustrated FIG. 1, an actually used area for forming the dark area potential is approximated by a linear function, and the first laser power E1 ($\mu J/cm^2$) for obtaining the target dark area potential Vd is calculated by using the following expression 1.

$$Vd=\alpha 1\times E1+V0 \quad (1)$$

α1: Coefficient

In this manner, the target dark area potential Vd (target value of the dark area potential Vd) can be represented by a linear function by using the first laser power E1 and the primary charging potential V0. To elaborate, the target dark area potential Vd can be obtained by the first laser power E1 and the primary charging potential V0. The coefficient α1 is previously obtained by an experiment or the like. The coefficient α1 is a coefficient at the time of the primary charging potential V0. When the primary charging potential V0 is high, the coefficient α1 is also increased.

In a part where the residual transfer toner is generated, the primary charging potential on the photosensitive member 1 is more decreased than the primary charging potential in a case where no toner exists because of an influence of the residual transfer toner. To elaborate, the absolute value of the potential is difficult to be raised (increased) by the charge in the part where the residual transfer toner exists, and the increase amount is lower than that in the residual transfer toner absent part.

At this time, the primary charging potential in the part where the residual transfer toner exists is set as V0'. The decrease amount ΔV0 at which the charging potential on the photosensitive member 1 is decreased by the presence of the residual transfer toner is in proportion to the residual transfer toner amount a as represented by the following expression 2.

$$\Delta V0=V0-V0'=\beta\times a \quad (2)$$

β: Coefficient

The coefficient β is previously obtained by an experiment or the like.

As described above in the section of Formation of the electrostatic latent image by laser exposure from above toner, the laser exposure from the laser exposure unit 3 is shielded by the residual transfer toner. The relationship illustrated in FIG. 4 between the residual transfer toner amount a and the laser power light shielding amount Eη shielded by the residual transfer toner is represented in the following expression 3.

$$E\eta=\gamma\times a \quad (3)$$

γ: Coefficient

The dark area potential Vd' of the residual transfer toner present part is obtained from the above-described relationship. At this time, since the primary charging potential is decreased by the residual transfer toner (the primary charging potential=V0'), α1 in the expression 1 becomes α2. From the expressions 1 to 3, the dark area potential Vd' is represented by the following expression 4.

$$Vd'=\alpha 2\times(E1-\gamma\times a)+(V0-\beta\times a) \quad (4)$$

In the part where the residual transfer toner is present, the primary charging potential V0' on the photosensitive member 1 is decreased by the influence of the toner (V0'=V0−ΔV0) from the expression 2. However, since the dark area potential is formed at the first laser power E1, it is possible to suppress the influence of the potential difference of the primary charging potential formed by the charging (the decreased amount ΔV0 of the charging potential on the photosensitive member 1) by an inclination α2 of the E-V curved line and the light shielding by the toner (see FIG. 1). ΔVd<ΔV0 is established.

This is because the decrease amount at which the absolute value of the potential on the photosensitive member is decreased by the exposure by the laser exposure unit 3 in the residual transfer toner present part is lower than that in the residual transfer toner absent part.

To elaborate, the following relationship is established.

$$(V0'-Vd')<(V0-Vd)$$

Herein, the expressions 1 to 3 are the linear functions according to the present exemplary embodiment. However, the expressions 1 to 3 are appropriately determined in accordance with the respective characteristics and may also be polynomial expressions or expressions composed of a plurality of curved lines. For example, in the expression 1 corresponding to the E-V curved line, the dark area potential Vd may be derived from a table including a factor such as an environment or the film thickness of the photosensitive layer or the like.

Hereinafter, a potential relationship of the printer that performs the above-described exposure control will specifically be described. More specifically, the exposure control is performed while the decrease in the film thickness by the printing is taken into account, but according to a mode described below, the charging roller application bias Vpri (−V) for forming the primary charging potential is fixed at a 1100 (−V) output even when the film thickness is decreased. According to this, the primary charging potential V0 is increased at the same charging roller application bias Vpri output when the film thickness is decreased. Since the first laser power E1 is controlled by the control unit 8, the dark area potential Vd is constant even when the primary charging potential V0 is increased. In this manner, when the dark area potential Vd is set to be constant, it is possible to secure the background part contrast potential Vb described above while the output of the developing bias Vdc is fixed. Herein, the control unit 8 is equivalent to an adjustment unit (adjustment apparatus).

When the film thickness of the photosensitive layer in an initial state is 15 (μ), the primary charging potential V0 in the residual transfer toner absent part is 550 (−V). The control unit 8 calculates a coefficient $\alpha 1_{15}$ corresponding to the inclination of the E-V curved line in the expression 1 from the film thickness. Herein, $\alpha 1_{15}=-3000$ is set. Then, the exposure is performed at the first laser power E1=0.017 (μJ/cm$^2$) so that the dark area potential Vd is set as a target value of 500 (−V). The residual transfer toner amount a generated by the image formation is a=0.2 (g/m$^2$), and the other coefficients are respectively β=100 and γ=0.02. The image formation is performed while the developing bias Vdc is set as 350 (−V). Since the residual transfer toner amount generated is 0.2 (g/m$_2$) since the decrease amount ΔV0 of the charging potential on the photosensitive member 1 is 20V in the residual transfer toner present part from the expression 2, the primary charging potential V0' is 530 (−V). When the primary charging potential is 530 (−V), a coefficient $\alpha 2_{15}$ is −2900. The coefficient α2 is corrected and calculated by the control unit 8 by using the coefficient α1 from a difference between the primary charging potentials V0 and V0'. However, the residual transfer toner passes through the charging roller 2 and advances to the exposure unit to be irradiated with the laser exposure from above the residual transfer toner, so that the dark area potential is formed. The dark area potential Vd' in the residual transfer toner present part is 493 (−V) from the expression 4.

In this manner, while the dark area potential is formed by the exposure, although the potential difference of the primary charging potential is 20 V, the potential difference of the dark area potential can be suppressed to 7 V.

Herein, Table 1 illustrates a relationship between the potential difference of the dark area potential in a case where the dark area potential is formed at the first laser power according to the present exemplary embodiment and in a case where the dark area potential is formed by the charge apparatus without using the first laser power according to a comparison example 1 and the generation of the positive ghost by the potential difference.

TABLE 1

| | Dark area potential difference (V) | Positive ghost |
|---|---|---|
| Present exemplary embodiment | 7 | Allowable generation |
| Comparison example 1 | 20 | Unallowable generation |

Although an unallowable positive ghost is generated in the formation of the dark area potential which is performed only by the charge apparatus according to the comparison example, it may be understood form Table 1 that the generation of the unallowable positive ghost can be suppressed by forming the dark area potential by the exposure according to the present exemplary embodiment.

According to the mode described here, the value of the dark area potential Vd at 500 (−V) in the residual transfer toner absent part and the value of the dark area potential Vd' at 493 (−V) in the residual transfer toner present part are equivalent to the values within a previously set target range (within a predetermined range) of the dark area potential. The target range of the dark area potentials Vd and Vd' is previously set so that the potential difference (dark area potential difference) ΔVd of the dark area potentials Vd and Vd' take values in an allowable range with regard to the generation of the positive ghost. In addition, according to this mode, in order that the dark area potentials Vd and Vd' are set as values within the target range, the first laser power E1 is controlled (the exposure amount is adjusted) in a manner that the dark area potential Vd takes the target value (500 (−V)) within the target rage. Moreover, this target range is preferably set so that the background part contrast potential Vb corresponding to the difference between the dark area potential (Vd, Vd') and the developing bias Vdc takes a value within a range (predetermined range) where the fog is not generated.

Next, a potential relationship of the printer is illustrated when printing of 10,000 sheets is performed by using the photosensitive member 1 and the above-described exposure control is performed when the film thickness of the photosensitive layer becomes 10 (μm).

First, a calculation of the film thickness of the photosensitive layer will be described. The film thickness M of the photosensitive layer (μm) is calculated by an expression 5 from a film thickness change amount mj (μm) of the photosensitive member 1 and an initial film thickness mi (μm) of the photosensitive member 1.

$$M=mi-mj=mi-\delta\times t \quad (5)$$

δ: Coefficient

The initial film thickness mi (μm) is information written in the memory 45 at the time of manufacturing, and the film thickness change amount mj (μm) is calculated from the coefficient δ and an accumulated print number t (sheet) (an accumulated number of the printed recording media P). The coefficient δ can previously be obtained from an experience. The control unit 8 can calculate the film thickness M of the photosensitive layer by writing mj to the memory 45 as appropriate.

Herein, the control unit 8 is equivalent to a derivation unit (derivation apparatus) configured to derive information related to a use history of the photosensitive member 1. In addition, the film thickness M of the photosensitive layer is equivalent to the information related to the use history of the photosensitive member 1. According to the present exemplary embodiment, the film thickness M of the photosensitive layer is calculated from the expression 5, but the calculation method is not limited to this. A table or the like equivalent to the expression 5 is previously stored, and according to this, the film thickness M of the photosensitive layer may be derived. According to the present exemplary embodiment, the film thickness M of the photosensitive layer is derived from the accumulated print number, but the derivation method is not limited to this. For example, the film thickness M may be derived from a drive rotation number of the photosensitive member 1 or a drive time.

The primary charging potential $V0_{10}$ in the residual transfer toner absent part when the film thickness is 10 (μm) is 600 (−V). A coefficient $\alpha 1_{10}$ calculated from this film thickness is −2100. Similarly as in a case where the film thickness is 15 (μm), the exposure is performed at the first laser power $E1_{10}$=0.044 (μJ/cm$^2$) so that the dark area potential Vd is set as 500 (−V). In other words, as the use amount of the photosensitive member (the accumulated print number) is increased and the film thickness of the photosensitive layer is decreased, the laser power (exposure amount) with respect to the non-image part is increased. The same applies to a, β, and γ as the case of the film thickness at 15 (μm).

The primary charging potential $V0'_{10}$ is 580 (−V) in the residual transfer toner present part. When the primary charging potential is 580 (−V), a coefficient $\alpha 2_{10}$ is −2000. To elaborate, the dark area potential Vd' in the residual transfer toner present part is 492 (−V) from the expression 4, and the potential difference of the primary charging potential at 20V that is originally generated in the residual transfer toner present part and the residual transfer toner absent part can be suppressed to the potential difference of the dark area potential at 8V.

Herein, Table 2 illustrates a relationship between the potential difference of the dark area potential in a case where the dark area potential is formed at the first laser power according to the present exemplary embodiment and in a case where the dark area potential is formed by the charge apparatus without using the first laser power according to a comparison example 2 and the generation of the positive ghost caused by the potential difference.

TABLE 2

| | Dark area potential difference (V) | Positive ghost |
|---|---|---|
| Present exemplary embodiment | 8 | Allowable generation |
| Comparison example 2 | 20 | Unallowable generation |

It may be understood from Table 2 that the generation of the unallowable positive ghost can be suppressed while the dark area charging potential is formed by the exposure even when the film thickness is decreased.

In this manner, it is possible to attain the above-described effect by appropriately controlling the first laser power E1 in accordance with the film thickness calculated from the accumulated print number.

According to the present exemplary embodiment, the control in a manner that the charging roller application bias Vpri output is fixed and the first laser power E1 is controlled to keep the dark area potential Vd constant is performed but is not limited to this. For example, a control of keeping the primary charging potential V0 constant irrespective of the film thickness or a control of fixing the first laser power E1 output to be constant may be performed. That is, the control unit 8 controls the first laser power E1 and/or controls the charging roller application bias Vpri so that the dark area potentials Vd and Vd' take values within the target range.

As described above, according to the present exemplary embodiment, the potential control of the photosensitive member 1 for forming the dark area potentials Vd and Vd' at the first laser power E1 is performed in the exposure procedure. According to this, even when the charging potential on the surface of the photosensitive member 1 is decreased because of the presence of the residual transfer toner, the influence of the decrease in the charging potential on the surface of the photosensitive member 1 can be suppressed by the exposure procedure. For this reason, it is possible to suppress the generation of the defective image. Therefore, while the generation of the defective image caused by the residual transfer toner is suppressed, it is possible to provide the image forming apparatus that realizes the miniaturization and the cost reduction.

Figure 5:
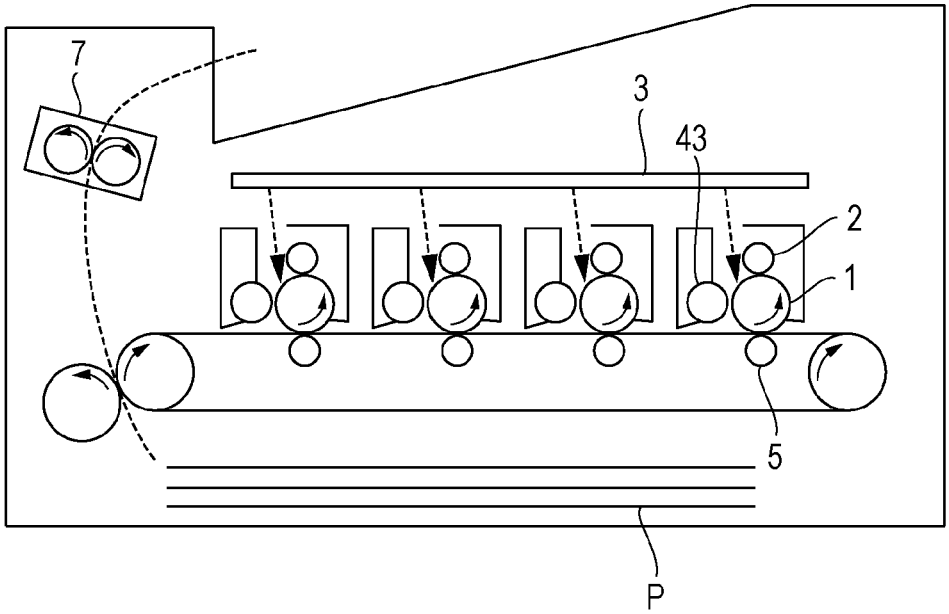
FIG. 5 is an explanatory diagram for describing a color image forming apparatus.

Herein, the monochrome printer has been described according to the present exemplary embodiment, but the configuration is not limited to this. The present invention can also appropriately be applied to a color printer, that is, a color image forming apparatus provided with a plurality of image forming units including the photosensitive member 1, the charging roller 2, the laser exposure unit 3, and the developing device 4 as illustrated in FIG. 5. In a case where the present invention is applied to the color printer, since the laser shielding amount of the expression 3 varies for each toner, a control in accordance with each laser shielding amount may be performed. The target range of the dark area potentials Vd and Vd' may previously be set for each image forming unit.

The laser powers E1 and E2 are obtained by controlling the current amount flowing through the laser diode, but the configuration is not limited to this. Two levels of exposure amounts (output values) formed by changing the light emission time by a pulse width modulation may also be used. Furthermore, the light source is not limited to the laser diode, and a light source using an LED or the like may also be used.

In addition, the potential on the photosensitive member after the exposure may vary depending on a difference in temperatures in the use environment where the printer 100 is used (environment where the printer 100 is arranged) in some cases. In view of the above, an environment detection unit (the environment detection apparatus) configured to detect the use environment of the printer 100 may be provided, and the first laser power E1 may be controlled and/or the charging roller application bias Vpri may be controlled in accordance with the detected environment in a manner that the dark area potentials Vd and Vd' take values within the target range.

The effects of the configuration according to the exemplary embodiment lastly described above are summarized as follows. According to the configuration according to the exemplary embodiment, in the image forming apparatus adopting the system of cleaning simultaneous with developing, it is possible to realize the miniaturization of the apparatus and the cost reduction while the generation of the defective image is suppressed which is caused by the decreased in the charging potential in the part of the image bearing member where the residual developer exists.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-107964 filed May 22, 2013 and Japanese Patent Application No. 2014-080316 filed Apr. 9, 2014, which are hereby incorporated by reference herein in their entirety.

What is claimed is:

1. An image forming apparatus that forms an image on a recording medium, the image forming apparatus comprising:

an image bearing member that bears a developer image;

a transfer apparatus configured to transfer the developer image borne on the image bearing member;

a charge apparatus configured to charge a surface of the image bearing member;

an exposure apparatus configured to expose the surface of the image bearing member with light to form a latent image on the surface of the image bearing member;

a control unit configured to control an exposure amount for exposing the surface of the image bearing member by the exposure apparatus; and a developing apparatus configured to collect a developer that is not transferred by the transfer apparatus and remains on the image bearing member and also supplies the developer to the latent image formed on the surface of the image bearing member to form the developer image on the surface of the image bearing member, wherein an image formation area where the latent image on the surface of the image bearing member can be formed is divided into an image part where the developer image is formed and a non-image part where the developer image is not formed, wherein the exposure apparatus exposes the non-image part with light at a first exposure amount and exposes the image part with light at a second exposure amount, the first exposure amount being lower than the second exposure amount, wherein when the charge apparatus charges a first area, on the surface of the image bearing member, in which the developer does not remain, a potential of the first area becomes a first potential (VO), and when the charge apparatus charges a second area, on the surface of the image bearing member, in which the developer remains, a Potential of the second area becomes a second potential (VO'), the second potential being lower than the first potential, wherein when the exposure apparatus exposes the first area charged by the charge apparatus with the first exposure amount, the potential of the first area becomes a third potential (Vd), and when the exposure apparatus exposes the second area charged by the charge apparatus with the first exposure amount, the potential of the second area becomes a fourth potential (Vd'), the fourth potential being lower than the third potential, and wherein the control unit sets the first exposure amount in such a way that a difference between the third potential and the fourth potential is smaller than a difference between the first potential and the second potential.

2. The image forming apparatus according to claim 1, wherein an increase amount, at which an absolute value of a potential of the surface of the image bearing member is increased by the charging by the charge apparatus, is lower in the second area as compared with the first area, and wherein a decrease amount, at which the absolute value of the potential of the surface of the image bearing member is decreased by the exposing with the first exposure amount by the exposure apparatus, is lower in the second area as compared with the first area.

3. The image forming apparatus according to claim 1, wherein the control unit is configured to adjust the exposure apparatus in a manner that the first exposure amount is increased as a use amount of the image bearing member is increased.

4. The image forming apparatus according to claim 1, further comprising a derivation apparatus configured to derive information related to a use history of the image bearing member, wherein the control unit adjusts at least one of the first exposure amount, and a magnitude of a potential applied to the charge apparatus, in accordance with the information derived by the derivation apparatus so that a difference between the first potential and the fourth potential is within a predetermined range.

5. The image forming apparatus according to claim 4, wherein the information related to the use history of the image bearing member is a film thickness of the image bearing member.

6. The image forming apparatus according to claim 4, wherein the derivation apparatus derives the information related to the use history of the image bearing member from an accumulated number of the recording media on which images are formed.

7. The image forming apparatus according to claim 1, further comprising:

an environment detection apparatus configured to detect a use environment of the image forming apparatus, wherein the control unit adjusts at least one of the first exposure amount and a magnitude of a potential applied to the charge apparatus in accordance with the environment detected by the environment detection apparatus so that a difference between the first potential and the fourth potential is within a predetermined range.

8. The image forming apparatus according to claim 1, further comprising:

a plurality of image forming units including the image bearing member, the charge apparatus, the exposure apparatus, and the developing apparatus, wherein the control unit sets the first exposure amount for each of the plurality of image forming units.

* * * * *